US010660191B1

(12) United States Patent
Hagelstein

(10) Patent No.: US 10,660,191 B1
(45) Date of Patent: May 19, 2020

(54) PROBABILISTIC MODELS FOR BEAM, SPOT, AND LINE EMISSION FOR COLLIMATED X-RAY EMISSION IN THE KARABUT EXPERIMENT

(71) Applicant: Peter L. Hagelstein, Carlisle, MA (US)

(72) Inventor: Peter L. Hagelstein, Carlisle, MA (US)

( * ) Notice: Subject to any disclaimer, the term of this patent is extended or adjusted under 35 U.S.C. 154(b) by 174 days.

(21) Appl. No.: 15/893,090

(22) Filed: Feb. 9, 2018

Related U.S. Application Data

(60) Provisional application No. 62/457,137, filed on Feb. 9, 2017.

(51) Int. Cl.
*H05G 2/00* (2006.01)
*G21K 1/06* (2006.01)
*G21K 1/02* (2006.01)

(52) U.S. Cl.
CPC ..... *H05G 2/00* (2013.01); *G21K 1/02* (2013.01)

(58) Field of Classification Search
CPC ..... G21K 1/06; G21K 1/062; G21K 1/067; H05G 2/008; H05G 2/006; H05G 2/005; H05G 2/00
See application file for complete search history.

(56) References Cited

U.S. PATENT DOCUMENTS 6,040,087 A 3/2000 Kawakami
6,183,817 B1 * 2/2001 Gersonde ..... G21K 5/04 250/251
2008/0112881 A1 5/2008 Lipson et al.
2015/0194287 A1 * 7/2015 Yun ..... H01J 35/08 378/44

FOREIGN PATENT DOCUMENTS

WO 2016188595 A1 12/2016
WO 2017127423 A3 7/2017

OTHER PUBLICATIONS

EPO, Extended European Search Report in Application No. 17742100.5 dated Nov. 6, 2019.
Pick, M.A., et al, Uptake Rates for Hydrogen by Niobium and Tantalum: Effect of Thin Metallic Overlayers, Journal of the Less-Common Metals, 1980, vol. 73, pp. 89-95.

* cited by examiner

*Primary Examiner* — David P Porta
*Assistant Examiner* — Fani Boosalis
(74) *Attorney, Agent, or Firm* — NK Patent Law

(57) ABSTRACT

The subject matter described herein includes a method of generating a collimated electromagnetic emission. The method includes producing an excitation in a sample of multiple particles by vibrationally stimulating the sample thereby transitioning each particle of at least a quantity of the multiple particles from a lower first energy state to a higher second energy state. The method also includes generating a collimated electromagnetic emission by de-excitation of at least a portion of the quantity of the multiple particles. A related apparatus is also provided.

24 Claims, 10 Drawing Sheets

PROBABILISTIC MODELS FOR BEAM, SPOT, AND LINE EMISSION FOR COLLIMATED X-RAY EMISSION IN THE KARABUT EXPERIMENT

CROSS-REFERENCE TO RELATED APPLICATIONS

The present application claims priority to and benefit from U.S. Provisional Patent Application Ser. No. 62/457,137 titled "Probabilistic Models for Collimated X-Ray Emission in the Karabut Experiment", filed on Feb. 9, 2017, the content of which is incorporated by reference herein.

TECHNICAL FIELD

The presently disclosed subject matter is directed towards a model for beam formation due to many emitting dipoles randomly positioned within a circle on a mathematically flat surface.

BACKGROUND

At the present time, Collimated X-ray emission near 1.5 keV in the Karabut experiment is an anomaly that cannot be explained by conventional solid state, atomic, or nuclear physics. In order for the X-rays to be collimated, there must either be an X-ray laser present, or else a phased-array collimation effect produced by emitting dipoles that radiate in phase. Although there have been arguments made in support of an X-ray laser origin of the effect, this approach suffers from an absence of a plausible mechanism, short excited-state electronic lifetimes, high power requirements, and an incompatibility between the experimental geometry and the need for an elongated laser medium for beam formation. This disclosure illustrates a model for beam formation due to many emitting dipoles randomly positioned within a circle on a mathematically flat surface. When the emitting dipole density is low, a speckle pattern is produced. Above a critical emitting dipole density beam formation occurs. The average intensity of the speckle and beam is estimated from statistical models at low and high dipole density, and combined to develop an empirical intensity estimate over the full range of dipole densities which compares well with numerical simulations. Beam formation occurs above a critical number of emitting dipoles, which allows for estimating the minimum number of emitting dipoles present in the Karabut experiment. The effect of surface deformations is considered; constant offsets do not appear to impact beam formation, and locally linear offsets direct the beam slightly off of normal. Minor displacements quadratic in the surface coordinates can produce focusing and defocusing effects, leading to a natural explanation for intense spot and line formation observed in the experiments.

SUMMARY

This summary is provided to introduce in a simplified form concepts that are further described in the following detailed descriptions. This summary is not intended to identify key features or essential features of the claimed subject matter, nor is it to be construed as limiting the scope of the claimed subject matter.

Disclosed herein is a method of generating a collimated electromagnetic emission. The method includes producing an excitation in a sample of multiple particles by vibrationally stimulating the sample thereby transitioning each particle of at least a quantity of the multiple particles from a lower first energy state to a higher second energy state. The method also includes generating a collimated electromagnetic emission by de-excitation of at least a portion of the quantity of the multiple particles.

According to one or more embodiments, vibrationally stimulating the sample includes establishing phase coherence among at least some of the multiple particles of the sample.

According to one or more embodiments, the collimated electromagnetic emission is generated by phased array emission.

According to one or more embodiments, the multiple particles of the sample are positioned on a planar support surface.

According to one or more embodiments, the planar support surface includes a cathode.

According to one or more embodiments, as the electromagnetic emission is generated, the multiple particles include phase coherent emitting dipoles.

According to one or more embodiments, the multiple particles of the sample are randomly positioned on the planar support surface.

According to one or more embodiments, the collimated electromagnetic emission includes a beam directed normal to the planar support surface.

According to one or more embodiments, the multiple particles of the sample are positioned within an area on the planar support surface, and the beam has a cross-sectional area essentially equivalent to the area on the planar support surface.

According to one or more embodiments, the planar support surface includes aligned crystal planes.

According to one or more embodiments, the crystal planes are aligned by rolling.

According to one or more embodiments, the planar support surface includes deformations that are quadratic or higher-order in transverse surface coordinates.

According to one or more embodiments, the deformations are produced by at least one of ion bombardment and sputtering.

According to one or more embodiments, the beam has a shape predetermined by a selected preparation of the deformations.

According to one or more embodiments, the collimated electromagnetic emission includes a beam generated by phased array emissions from the multiple particles of the sample, the multiple particles of the sample are positioned on a support surface having a circular diameter, and the support surface varies from a plane according to the time varying function $u(x, y)=c(t)x^2+d(t)y^2+f(t)xy$ in which u is defined as a displacement from the plane, x is defined as a first position coordinate along a first axis in the plane, y is defined as a second position coordinate along a second axis in the plane perpendicular to the first axis, c(t) is a time varying first parameter, d(t) is a time varying second parameter, and d(t) is a time varying third parameter.

According to one or more embodiments, the beam focuses as a spot smaller than the circular diameter at a distance Z from the support surface when $c(t)=0.80/2Z$; $d(t)=0.80/2Z$; and $f(t)=0$.

According to one or more embodiments, the beam focuses as a line segment having a length greater than the circular diameter at a distance Z from the support surface when $c(t)=-0.30/2Z$; $d(t)=0.90/2Z$; and $f(t)=0$.

According to one or more embodiments, vibrationally stimulating the sample includes producing excitations via up-conversion of vibrational energy.

According to one or more embodiments, the collimated electromagnetic emission includes X-ray emission.

According to one or more embodiments, the X-ray emission is generated by up-conversion of vibrational energy resulting in phase coherence.

According to one or more embodiments, an apparatus for generating a collimated electromagnetic emission includes a support structure having a surface and a sample of multiple particles positioned on the surface. The apparatus also includes a device configured to vibrationally stimulate the sample thereby transitioning each particle of at least a quantity of the multiple particles from a lower first energy state to a higher second energy state such that a collimated electromagnetic emission is generated by de-excitation of at least a portion of the quantity of the multiple particles.

According to one or more embodiments, the surface of the support structure is planar.

According to one or more embodiments, the collimated electromagnetic emission includes a beam directed normal to the surface.

According to one or more embodiments, the multiple particles of the sample are randomly positioned on the surface.

According to one or more embodiments, the surface includes deformations that are quadratic or higher-order in transverse surface coordinates.

According to one or more embodiments, the support structure includes a cathode.

According to one or more embodiments, the surface includes aligned crystal planes.

BRIEF DESCRIPTION OF THE DRAWINGS

The foregoing, as well as the following Detailed Description of preferred embodiments, is better understood when read in conjunction with the appended drawings. For the purposes of illustration, there is shown in the drawings exemplary embodiments; however, the presently disclosed subject matter is not limited to the specific methods and instrumentalities disclosed.

The embodiments illustrated, described, and discussed herein are illustrative of the present invention. As these embodiments of the present invention are described with reference to illustrations, various modifications or adaptations of the methods and or specific structures described may become apparent to those skilled in the art. It will be appreciated that modifications and variations are covered by the above teachings and within the scope of the appended claims without departing from the spirit and intended scope thereof. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

DETAILED DESCRIPTION

Figure 1:
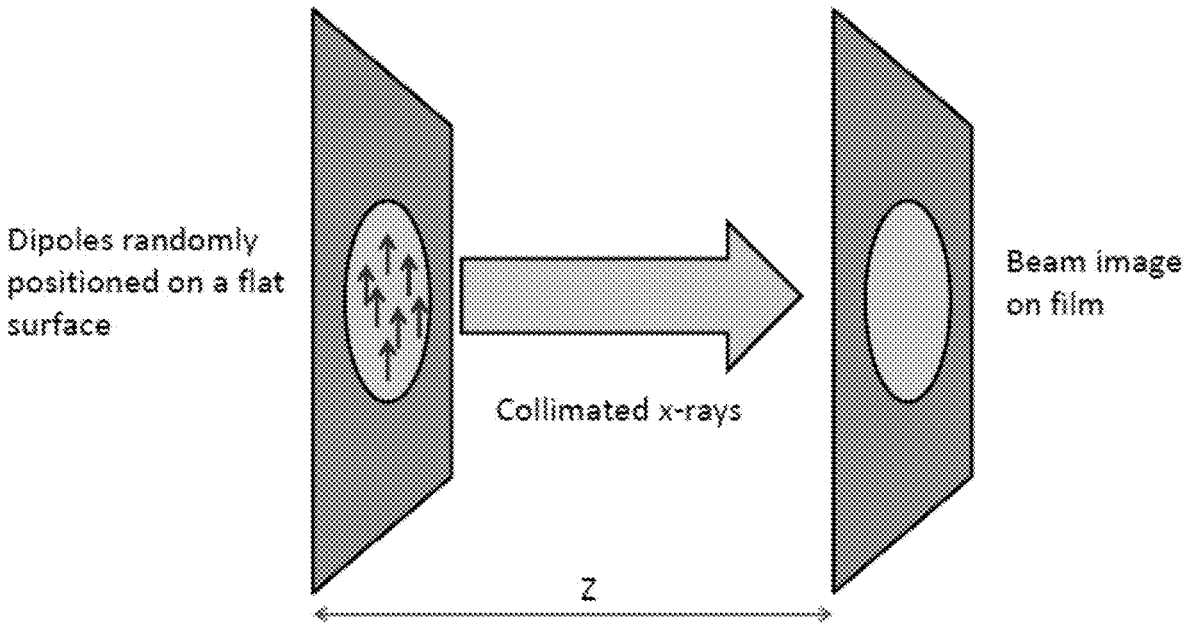
FIG. 1 is a schematic of a model according to one or more embodiments of the presently disclosed subject matter.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although the term "step" may be expressly used or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, when referring to a value or to an amount of mass, weight, time, volume, concentration, and/or percentage it can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the presently disclosed subject matter.

At least one embodiment of the presently disclosed subject matter is illustrated throughout the drawings and in particular reference to FIG. 1.

Figure 2:
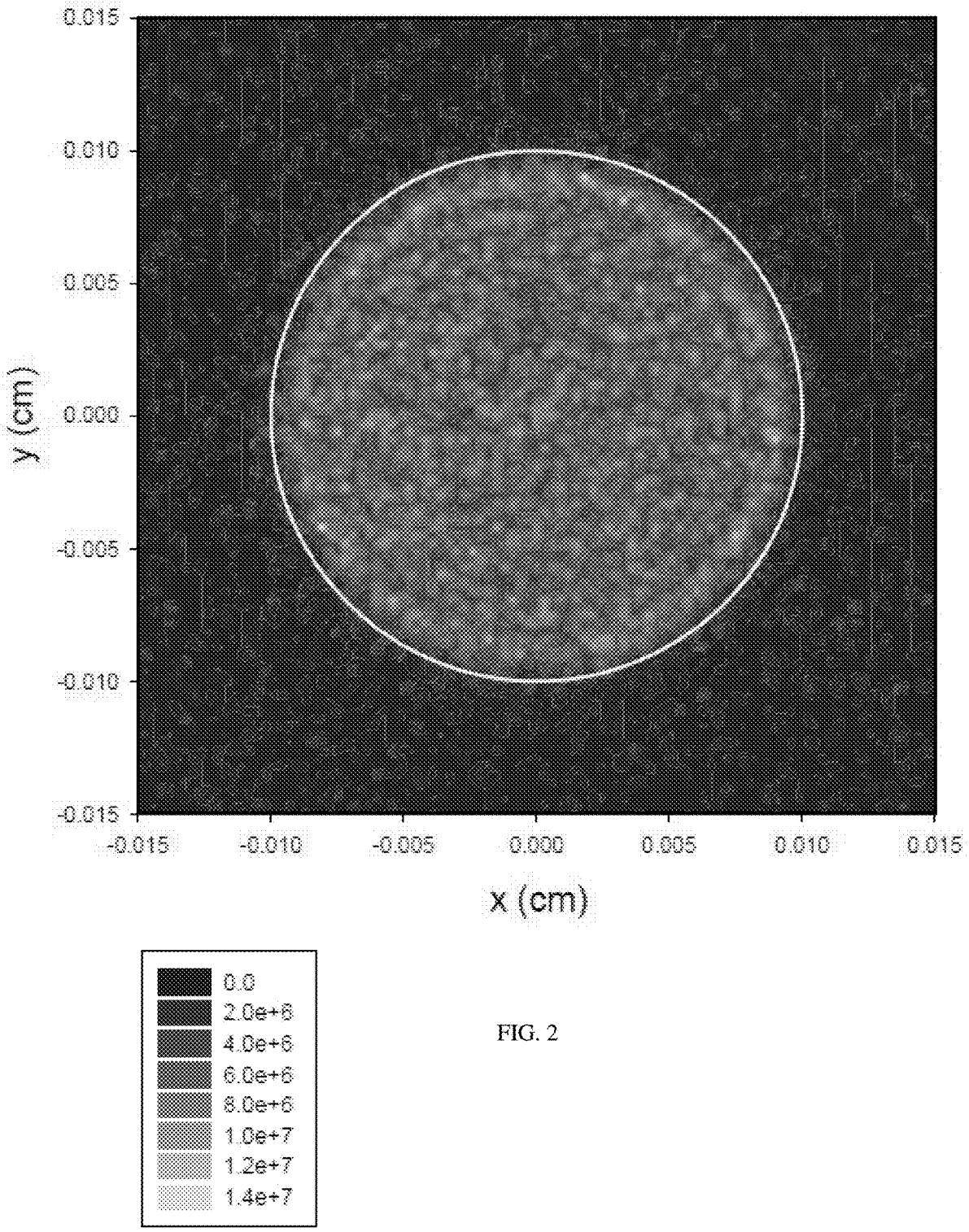
FIG. 2 is a beam image plane graph according to one or more embodiments of the presently disclosed subject matter.

At least one embodiment of the presently disclosed subject matter is illustrated throughout the drawings and in particular reference to FIG. 2.

INTRODUCTION

Karabut reported the observation of excess heat and other anomalies in glow discharge experiments in the early 1990s. In subsequent experiments Karabut noticed that soft X-rays near 1.5 keV were emitted, and that they were collimated upward in his experiment normal to the cathode surface. This effect was studied for more than a decade, and was found to be independent of the cathode metal (the effect was seen with Al, and with other metals through W), also to be independent of which discharge gas was used (collimated emission was seen with $H^2$, $D^2$, He, Ne, Ar and Xe).

Collimated X-ray emission in this experiment is a striking anomaly for a variety of reasons. In order to arrange for collimated X-ray emission, an X-ray laser, or coherence among the emitter phases is needed; either option would have deep implications. Karabut was convinced that he had made an X-ray laser. Recently there has been speculation about the possibility of an X-ray laser mechanism in connection with Karabut's experiment.

It is difficult to create a relevant population inversion and to amplify X-rays. The notion of a population inversion at 1.5 keV involving electronic transitions in a solid state environment is unthinkable due to the very short lifetime. And then even if somehow a population inversion could be generated, enough amplifier length would be needed to produce a collimated beam (the solid state medium is very lossy), as well as an amplifier geometry consistent with the observed beam formation. The very broad line shape associated with the collimated emission also argues against an X-ray laser mechanism. All of these obstacles combine to rule out an X-ray laser mechanism associated with the solid. The primary obstacle associated with an X-ray laser in the gas phase is the absence of relevant electronic transitions in hydrogen, deuterium, helium, and in neon gas. In this case there is a possibility of a ubiquitous impurity in the discharge gas; however, this leads to an additional obstacle of coming up with enough inverted atoms, molecules or ions to provide many gain lengths. A consideration of the relatively long (millisecond) duration of the collimated X-ray emission following the turning off of the discharge current provides an additional obstacle. If the upper state radiative life time is long then the gain is very low; and if the gain is high then the upper state radiative life time is very short and the power requirement becomes prohibitive.

Collimated X-ray emission is considered a result of a phased array emission effect. In this case serious issues remain; such as how excitation is produced (which in this case is much easier since a population inversion is not required); and how phase coherence might be established. Both excitation and phase coherence could be developed via the up-conversion of vibrations to produce nuclear excitation in $^{201}$Hg, which is special because it has the lowest energy excited state (at 1565 eV) of any of the stable nuclei. Earlier studies of models that describe up-conversion in the lossy spin-boson model, and various extensions and generalizations.

The presently disclosed subject matter considers models for beam formation of the collimated X-ray emission in Karabut's experiment based on the assumption of phase coherent emitting dipoles randomly positioned on a plane, in connection with the "diffuse" X-ray emission effect observed under "normal" high-current operating conditions. The collimated X-rays in this case were observed to be normal to the cathode in a beam essentially the same size as the cathode. Beam formation in the high dipole density of the model (where the emission is produced from localized dipoles) works the same way. When the emitting dipole density is low then no beam forms, but a speckle pattern is produced. It might be proposed that the very intense spots seen in the experiments following the turning off of the discharge are connected with the random constructive interference effects that lead to speckle. Individual spots associated with the speckle pattern are too small to account for this "sharp" emission effect, and that speckle cannot account for lines or curves. Spot formation and line formation follow naturally from models that describe surface deformations that are quadratic or higher-order in the transverse surface coordinates.

A weak speckle pattern is generated at low emitting dipole density, and a beam is produced when the emitting dipole density is high. A critical number or density of emitting dipoles can be estimated for the development of a beam. Since beam formation is reported in Karabut's experiment, it is possible to develop a constraint on the number of emitting dipoles consistent with experiment. A small amount of mercury contamination in the chamber might result in some mercury sputtered onto the cathode surface, resulting in a relatively small number of mercury nuclei that emit on a broadened version of the 1565 eV transition in $^{201}$Hg. It is possible to develop a lower bound on the number of mercury atoms present near the surface, to see whether it is consistent with the proposed picture.

Key features of the model which allows for collimation of the emitted beam normal to the surface are the phase coherence assumed, as well as the surface itself (which in the model is mathematically flat). The cathode surface is not flat at the atomic scale, since whatever the surface looked like initially is modified in the ion bombardment, and surface loss through sputtering, which occurs during discharge operation at high current density. Mercury atoms in the discharge gas ionized above the cathode fall would be accelerated toward the cathode surface in this picture with an energy of up to a few keV, which means that they would end up randomly positioned in the outer 5-10 nm of the cathode surface. Alignment in a plane is unexpected, as assumed in the model, unless there were an ordering of the crystal planes so that some fraction of them were aligned with the cathode surface. The expected randomization of the locations of the mercury atoms inside the cathode surface would make beam formation to be impossible, except from the occasional crystal plane accidentally aligned with the surface. However, it is well known in the literature that substantial deformation of a metal, as occurs during rolling, can result in a substantial alignment of the local crystal planes with the surface. It seems likely that the cathodes used by Karabut were from stock that was rolled, so it is expected the cathodes themselves to provide a source of crystal planes oriented with the surface. During the discharge operation the cathodes undergo additional surface deformation due to local thermal effects and electrostatic forces, which provides a natural mechanism for intense spot and line formation. In this picture the crystal ordering built in during rolling is largely maintained during the deformations that occurs during discharge operation.

Basic Model

Models for random arrays of emitting dipoles have been studied; in the case of random linear arrays; a model for a random distribution of antennas in a two dimensional circle has been studied; and for a random distribution in a triangle. Statistical models for the analysis of beam formation from random antenna arrays have also been studied.

Following the discussion above, a simple model for X-ray emission due to a collection of identical emitting dipoles that are randomly distributed in a plane is illustrated. The vector potential in the case of oscillating electric dipoles is the summation $$A(r) = -i\sum_j \frac{kp_j}{|r-r_j|}\exp\{ik|r-r_j|\} \to -i\frac{kp}{|r|}\sum_j \exp\{ik|r-r_j|\}, \quad \text{Equation 1}$$

assuming uniform phase, identical dipoles, and focused on the field that results far away from the plane. The nuclear transition in $^{201}$Hg is a magnetic dipole transition, which provides the motivation to consider the analogous approximation for a set of oscillating magnetic dipoles $$A(r) = i\sum_j \frac{k\hat{n}_j \times m_j}{|r-r_j|}\exp\{ik|r-r_j|\} \to i\frac{k\hat{n}\times m}{|r|}\sum_j \exp\{ik|r-r_j|\}. \quad \text{Equation 2}$$

In either case, the resulting intensity is proportional to $$I(r) \sim \left|\sum_j \exp\{ik|r-r_j|\}\right|^2 = \sum_j\sum_{j'} \exp\{ik(|r-r_j|-|r-r_{j'}|)\}. \quad \text{Equation 3}$$

The dipoles are assumed to lie in the emitting plane defined by $z_j=0$, and of interest is the intensity pattern produced at image plane defined by z=Z (a schematic is shown in FIG. 1). Following these assumptions the following equation is derived $$I(x, y, Z) \sim \sum_j\sum_{j'} \exp\left\{ik\left(\sqrt{(x-x_j)^2+(y-y_j)^2+Z^2} - \sqrt{(x-x_{j'})^2+(y-y_{j'})^2+Z^2}\right)\right\}. \quad \text{Equation 4}$$

Simulations based on this model predict beam formation for small areas when the dipole density is high, and spot formation in the case of larger areas or when the dipole density is low.

Since the locations of the dipoles are probabilistic, it will be of interest to estimate the expectation value of the intensity $$E[I(r)] \sim \sum_j\sum_{j'} E[\exp\{ik(|r-r_j|-|r-r_{j'}|)\}]. \quad \text{Equation 5}$$

What follows focuses on specific model results for the summation on the right-hand side.

Beam Formation in the High Density Limit

Beam formation occurs when there are several dipoles that are sufficiently close together so that their contributions can combine coherently. In this regime there is the possibility of making use of a Taylor series expansion according to Equation 6.

A schematic of the model is illustrated in FIG. 1. Phase coherent dipoles are positioned randomly within an emitting area of the cathodes surface, and radiate to form a beam if the emitting dipoles are in phase and have a sufficiently high density.

$$\begin{aligned} |r-r_j| &= \sqrt{(x-x_j)^2+(y-y_j)^2+Z^2} \\ &= Z\sqrt{1+\frac{(x-x_j)^2}{Z^2}+\frac{(y-y_j)^2}{Z^2}} \\ &= Z\left[1+\frac{(x-x_j)^2}{2Z^2}+\frac{(y-y_j)^2}{2Z^2}+\ldots\right]. \end{aligned} \quad \text{Equation 6}$$

In this case the difference can be expressed as $$\begin{aligned} |r-r_j|-|r-r_{j'}| &= \frac{(x-x_j)^2}{2Z}+\frac{(y-y_j)^2}{2Z} - \frac{(x-x_{j'})^2}{2Z}-\frac{(y-y_{j'})^2}{2Z}+\ldots \\ &= \frac{(x_{j'}-x_j)x+(y_{j'}-y_j)y}{Z} + \frac{x_j^2-x_{j'}^2+y_j^2-y_{j'}^2}{2Z}+\ldots \end{aligned} \quad \text{Equation 7}$$

Assuming that beam formation is dominated by contributions from the lowest order terms in the Taylor series expansion, the following equation is derived $$I(x, y, Z) \sim \sum_j\sum_{j'} \exp\left\{ik\left(\frac{(x_{j'}-x_j)x+(y_{j'}-y_j)y}{Z}+\frac{x_j^2-x_{j'}^2+y_j^2-y_{j'}^2}{2Z}\right)\right\}. \quad \text{Equation 8}$$

The locations of the emitting dipoles are random variables, so that the intensity will be random as well. It will be of interest to estimate the expectation value of the intensity which can be written as $$E[I(x, y, Z)] \sim \sum_j\sum_{j'} E\left[\exp\left\{ik\left(\frac{(x_{j'}-x_j)x+(y_{j'}-y_j)y}{Z}+\right.\right.\right. \quad \text{Equation 9}$$

-continued $$\frac{x_j^2 - x_{j'}^2 + y_j^2 - y_{j'}^2}{2Z}\Bigg)\Bigg\}\Bigg].$$

Assuming that the various $x_j$ and $y_j$ values are independent, then this becomes $$E[I(x, y, Z)] \sim \sum_j \sum_{j'} E\left[\exp\left\{ik\left(\frac{-2x_j x + x_j^2}{2Z}\right)\right\}\right] E\left[\exp\left\{-ik\left(\frac{-2x_{j'} x + x_{j'}^2}{2Z}\right)\right\}\right],$$

$$E\left[\exp\left\{ik\left(\frac{-2y_j y + y_j^2}{2Z}\right)\right\}\right] E\left[\exp\left\{-ik\left(\frac{-2y_{j'} y + y_{j'}^2}{2Z}\right)\right\}\right] = N^2\left|E\left[\exp\left\{ik\left(\frac{-2x_j x + x_j^2}{2Z}\right)\right\}\right] E\left[\exp\left\{ik\left(\frac{-2y_j y + y_j^2}{2Z}\right)\right\}\right]\right|^2. \quad \text{Equation 10}$$

For simplicity, assume uniform probability distributions for a square emitting region defined by $$f_X(x_j) = \frac{1}{L}(-L/2 < x < L/2),$$
$$f_Y(y_j) = \frac{1}{L}(-L/2 < x < L/2). \quad \text{Equation 11}$$

Also for simplicity focus on the origin at the image, so that $$E[I(0, 0, Z)] \sim N^2\left|E\left[\exp\left\{ik\left(\frac{x_j^2}{2Z}\right)\right\}\right] E\left[\exp\left\{ik\left(\frac{y_j^2}{2Z}\right)\right\}\right]\right|^2. \quad \text{Equation 12}$$

This can be approximated as $$E\left[\exp\left\{ik\left(\frac{x_j^2}{2Z}\right)\right\}\right] = \int_{-L/2}^{L/2} f_X(x')\exp\left\{ik\left(\frac{x_j^2}{2Z}\right)\right\}dx' \to \frac{1}{L}\int_{-\infty}^{\infty}\exp\left\{ik\left(\frac{x_j^2}{2Z}\right)\right\}dx' = \frac{1}{L}\sqrt{\frac{i2\pi Z}{k}} = \frac{1}{L}\sqrt{i\lambda Z}. \quad \text{Equation 13}$$

Resulting in $$E[I(0, 0, Z)] \sim \frac{(\lambda Z)^2}{L^4}N^2. \quad \text{Equation 14}$$

The numbers are consistent with this estimate in the limit of high dipole density for a square emitting region. Adapting this formula to emission from a circular area by simply modifying the area appears to work well in comparison with numerical results.

Average Intensity in the Low Density Limit

The expectation value of the intensity is proportional to $$E[I(r)] \sim \sum_j \sum_{j'} E[\exp\{ik(|r - r_j| - |r - r_{j'}|)\}]. \quad \text{Equation 15}$$

In the high density limit it was possible to use a Taylor series approximation, as well the separability of the sums in j and in j', to develop an estimate for the expectation value. In the low density limit it is possible to develop an estimate for the expectation value of the intensity by neglecting contributions from dipoles at different locations; at low density there are not nearby emitting dipoles for local phase coherence to contribute significantly. In this case it can be written as $$E[I(r)] \sim \sum_j E[\exp\{ik(|r - r_j| - |r - r_j|)\}] + \sum_j \sum_{j' \neq j} E[\exp\{ik(|r - r_j| - |r - r_{j'}|)\}] = N + \sum_j \sum_{j' \neq j} E[\exp\{ik(|r - r_j| - |r - r_{j'}|)\}] \to N. \quad \text{Equation 16A}$$

When the dipole density is low then the expectation value of the complex terms can be thought of as involving random phases so that $$E[\exp\{ik(|r - r_j| - |r - r_{j'}|)\}] \to E[e^{i\theta}] = \frac{1}{2\pi}\int_0^{2\pi} e^{i\theta}\, d\theta = 0. \quad \text{Equation 16B}$$

In this limit there is no beam formation; instead there is a speckle pattern with average intensity proportional to N, in the vicinity of where a beam might have formed if N were higher, and also away from where the beam might have formed.

It is possible to develop an empirical approximation that includes both the contribution from the low density limit and from the high density limit according to $$E[I(r)] \sim \left|\sum_j \exp\{ik|r - r_j|\}\right|^2 = \begin{cases} N + \left(\frac{\lambda Z}{L^2}\right)^2 N^2, & \text{within beam pattern,} \\ N, & \text{outside of beam.} \end{cases} \quad \text{Equation 17}$$

This result is closely related to the exact formal result for the expected value.

Numerical Results

Simulations have been carried out with randomly located dipoles in a square corresponding to the models described above, and have found good agreement with the simple probabilistic models outlined above. The exposed surface of the cathodes in the Karabut experiment are circular, which leads to the generalization $$E[I(r)] \sim E\left[\left|\sum_j \exp\{ik|r-r_j|\}\right|^2\right] = \begin{cases} N + \left(\frac{\lambda Z}{\pi R^2}\right)^2 N^2, & \text{within beam pattern,} \\ N, & \text{outside of beam} \end{cases} \quad \text{Equation 18}$$

appropriate to emitting dipoles within a circular region of radius R.

An example of beam formation is illustrated in FIG. 2, where dipoles randomly localized on a plane within a circle of radius 100 μm results in a circular beam with a radius 100 μm. Diffraction rings are apparent in the image which are a result of the discontinuity in the dipole density near the edge of the circular emitting area. A speckle pattern is detectable which results from the limited number of dipoles present in the calculation.

Figure 3:
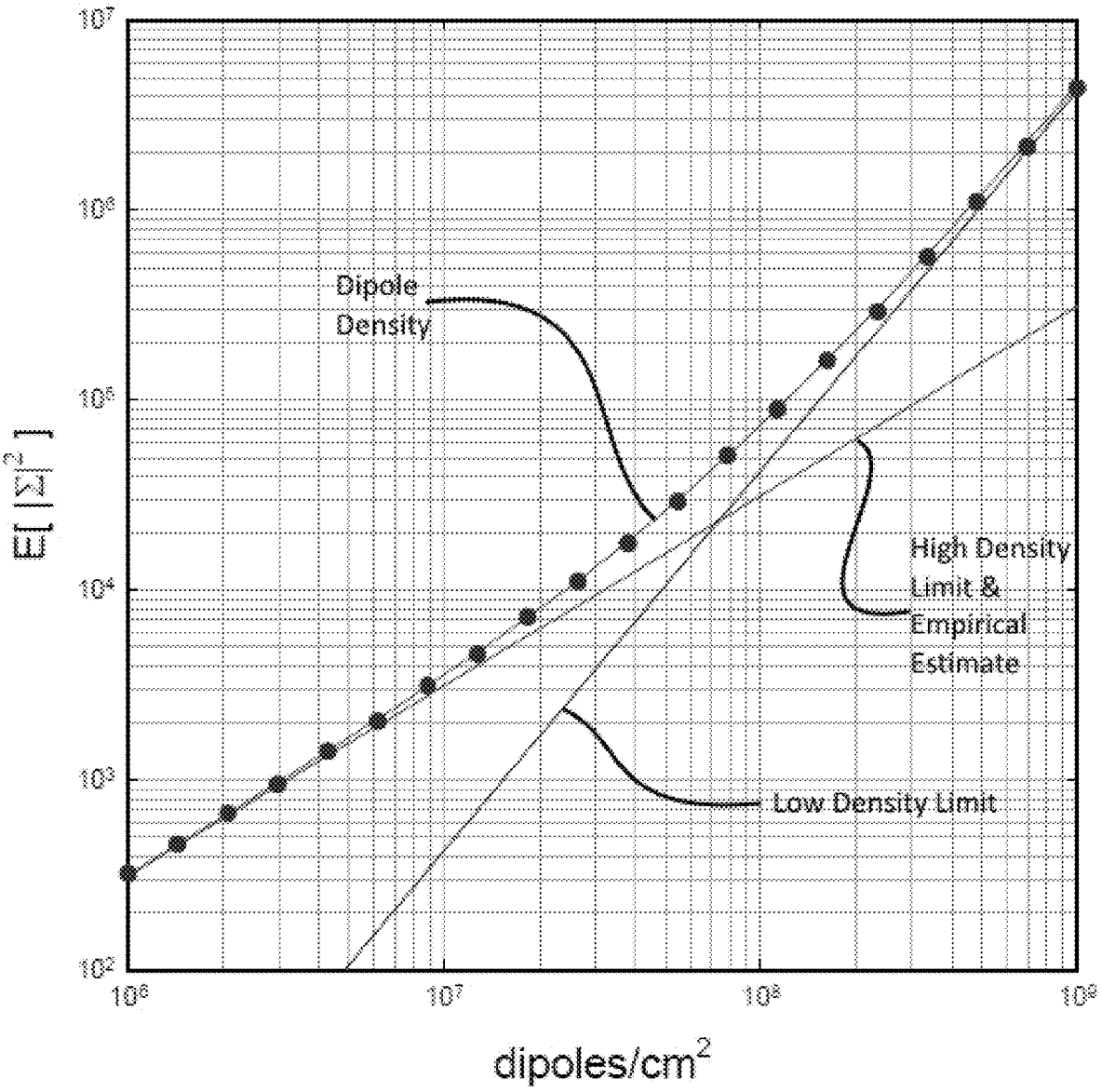
FIG. 3 is a graph of expectation value as a function of dipole density according to one or more embodiments of the presently disclosed subject matter.

In FIG. 3 is shown the average intensity (from many simulations) in the case of a 100 μm radius circle containing random emitting dipoles and a 100 μm radius circle on the image plane displaced 25 cm in z. As illustrated in FIG. 3, at low dipole density the average intensity is that of a spot pattern, and at high intensity the average intensity matches the analytic estimate. The empirical formula of Equation (18) is seen to be a good match over the whole range of dipole densities.

Beam Formation in the Karabut Experiment

There are no published photographic records of beam formation in Karabut's experiment. There are two photographs that show the damage done to a Be window and a plastic window. It might have been possible to discern the amount of speckle present from an X-ray photographic image of the beam, which based on the analysis above would have provided information about how many emitting dipoles are present. In some of the photographic spectra taken in the bent mica crystal spectrometer configuration, there is obvious speckle present, which illustrates that the quadratic beam contribution to the intensity is not so many orders of magnitude greater than the linear speckle contribution.

As illustrated in FIG. 2, a beam at the image plane located at Z=25 cm in the case of a dipole density of $10^9$ $cm^{-2}$ is localized in a circle of radius 100 μm. Marked is a circle of radius 100 μm.

From the empirical model described above, a critical number of dipoles $N_0$ at which the linear and quadratic contributions match can be defined as $$N_0 = \left(\frac{\lambda Z}{\pi R^2}\right)^2 N_0^2. \quad \text{Equation 19}$$

Therefore $$N_0 = \left(\frac{\pi R^2}{\lambda Z}\right)^2. \quad \text{Equation 20}$$

Assuming that phase coherence among the emitting dipoles is established over the entire surface of the cathode, a numerical estimate for the critical number of dipoles can be developed. For this estimate assume $$R=0.5 \text{ cm}, \lambda=8 \text{ nm}, Z=25 \text{ cm}. \quad \text{Equation 21}$$

The corresponding critical number in this case is $$N_0=1.5\times10^{11} \quad \text{Equation 22}$$

FIG. 3 illustrates the expectation value $E[|\Sigma_j \exp\{ik|r-r_j|\}|^2]$ as a function of dipole density, low density limit, high density limit, and empirical estimate.

In this scenario good beam formation is expected when the number of dipoles is larger than $N_0$ by an order of magnitude or more.

Another possibility is that phase coherence is established over only a part of the cathode surface, in which case the critical number of dipoles would be smaller by the square of the ratio of the coherence area to the cathode area.

Spot Formation

When the dipole density is low, speckle formation in the image plane can be observed, which is a consequence of fluctuations in the intensity. What is of interest is the development of a model that we can use to estimate the intensity of a spot given the number of emitting dipoles in a given area.

The intensity is determined from the random locations of the dipoles according to $$I(r) \sim \left|\sum_j \exp\{ik|r-r_j|\}\right|^2. \quad \text{Equation 23}$$

To form a spot the phases associated with the different dipoles need to be nearly the same. In this model what is not of interest is the phase coherence associated with beam formation, in which the contribution from many dipoles near a point add coherently. Instead we are interested in spot formation where the contribution from dipoles that are well separated combine randomly.

Since the contribution from each dipole is assumed to be equal in this model, the only difference in the contribution comes from the phase factor. If the dipole positions are random, then it can be presumed that the associated phases are random as well. Consequently, the simpler model is defined by $$\theta = \left|\sum_{j=1}^{N} \exp\{i\phi_j\}\right|^2 = \sum_{j=1}^{N}\sum_{k=1}^{N} \exp\{i(\phi_j - \phi_k)\}. \quad \text{Equation 24}$$

From numerical simulations, the associated probability distribution is exponential in θ according to $$f_\Theta(\theta) \to \frac{1}{N}\exp\left\{-\frac{\theta}{N}\right\}. \quad \text{Equation 25}$$

This result is consistent with a random walk model in two dimensions, and is well known in the literature in the context of speckle. In the event that fewer than the critical number of dipoles emit in this model, then there is little or no beam apparent, but instead individual randomly positioned spots associated with speckle.

According to this model the average intensity will be proportional to N $$E[I] \sim E[\theta] = N \quad \text{Equation 26}$$

with spots at higher intensity being rarer exponentially in the intensity. This result is consistent with the low dipole density model discussed briefly above, where $$E[I(r)] \sim E\left[\left|\sum_j \exp\{ik|r - r_j|\}\right|^2\right] = N. \quad \text{Equation 27}$$

Figure 4:
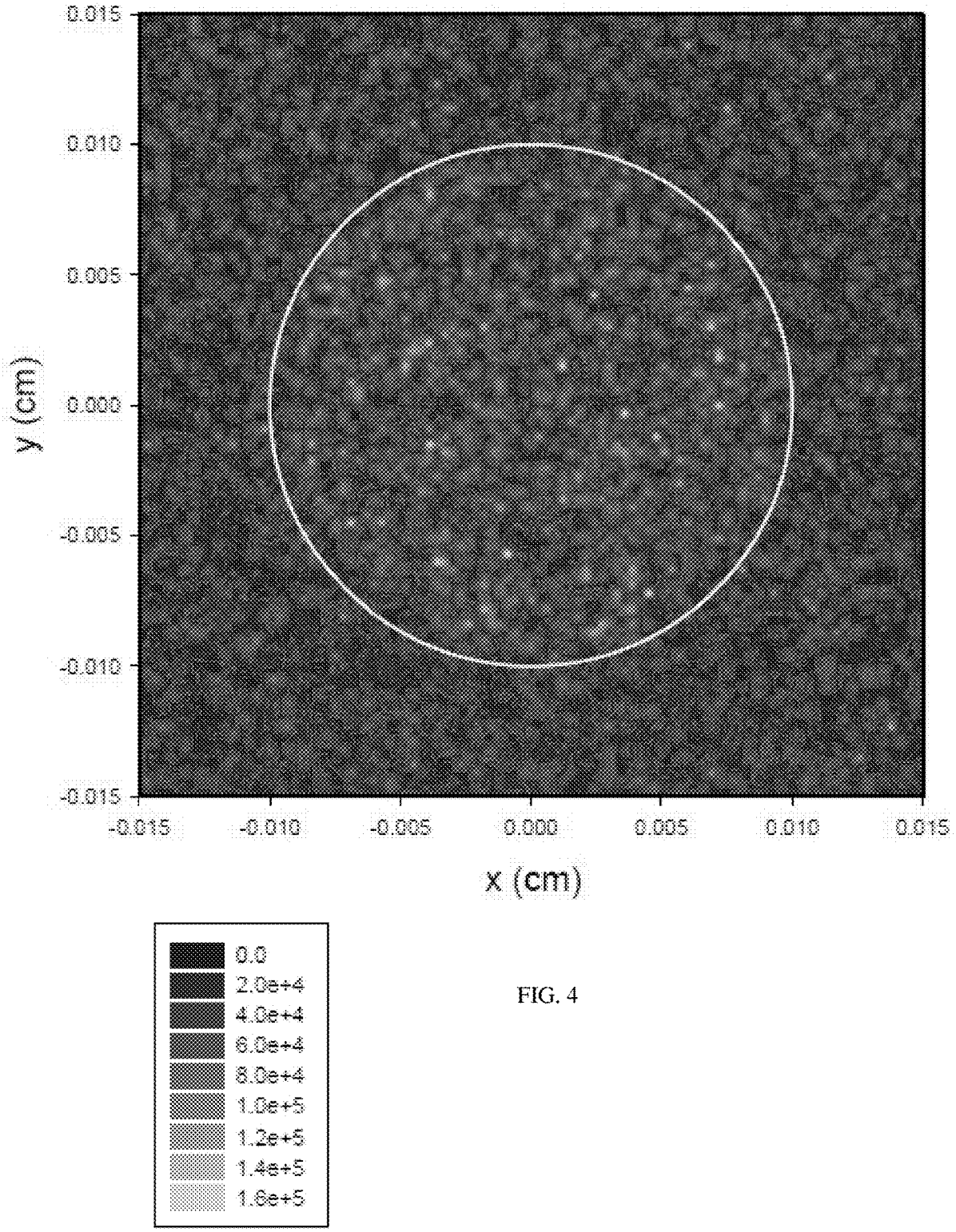
FIG. 4 is a beam image plane graph according to one or more embodiments of the presently disclosed subject matter.
Figure 5:
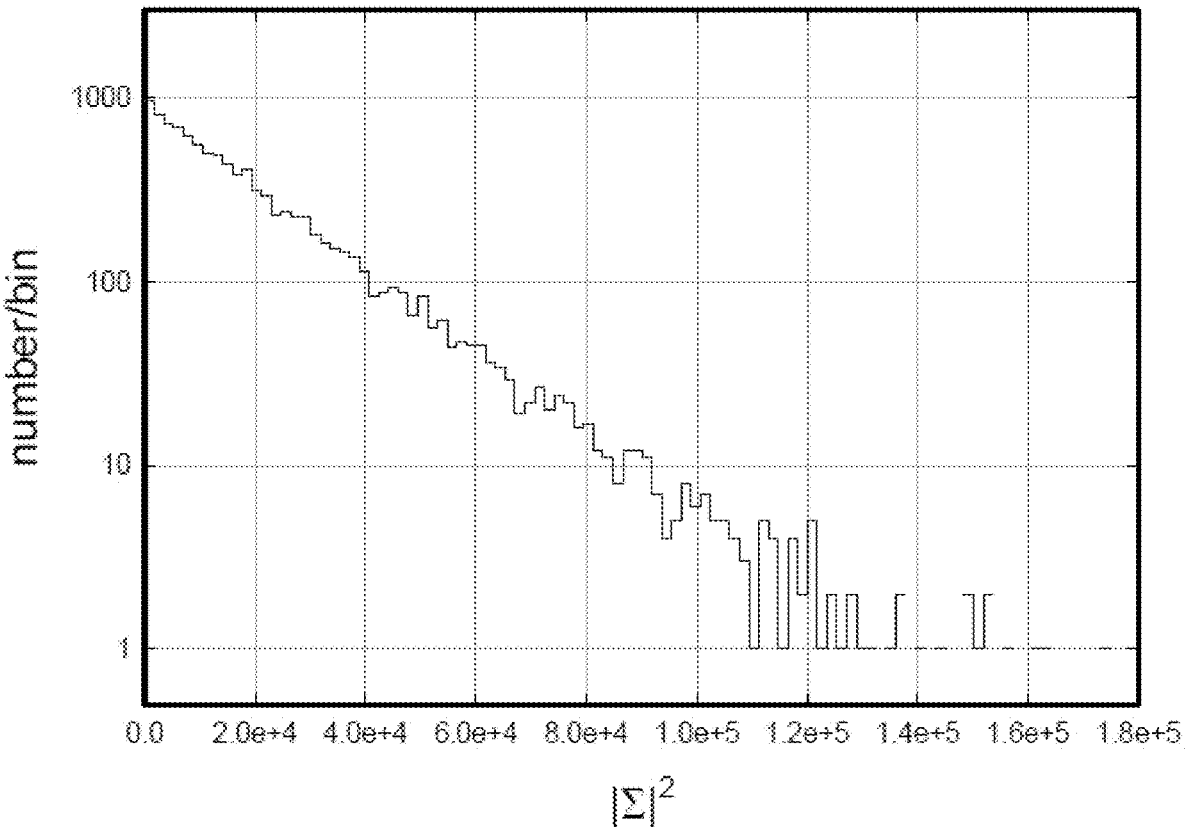
FIG. 5 is a histogram of intensity for speckle pattern according to one or more embodiments of the presently disclosed subject matter.

FIG. 4 illustrates a calculated image of the weak beam and spots under conditions where the density of dipoles is lower, so that the total number of emitting dipoles is a bit less than the critical number. In this case the dipole density is 5×10 cm−2, and the critical density needed for beam formation is about 7.4×10 cm−2. A histogram of intensities for the speckle pattern and weak beam inside of the indicated circle is shown in FIG. 5, and is seen to be close to exponential consistent with the discussion above, and in this case the number of match dipoles in the circle is a reasonable match to the exponential fall off.

Karabut reported that the "diffuse" spectra observed appears when the discharge is running, and that the very intense "sharp" emission could be seen when the discharge was turned off suddenly. In this case there is a large current spike (short in time) which accompanies the turning off of the current. Of interest is how this "sharp" emission might be interpreted. It has been proposed that this effect could be a result of Dicke superradiance from emitting dipoles in a localized region, where the emitting region was thought to be on the order of a square millimeter. In the following section surface deformations will be considered, which will provide a superior interpretation.

One hypotheses is the very intense spots might be a speckle effect under conditions where the individual dipole emission is stronger than in the case of beam formation. One argument against such a proposal is that individual speckles in this calculation are quite small, with a peak intensity only over a few microns by a few microns. The intense features in Karabut's data are much larger.

FIG. 4 illustrates a beam at the image plane (located at Z=25 cm in the case of a dipole density of $5\times10^7$ $cm^{-2}$ localized in a circle of radius 100 μm. Marked is a circle of radius 100 μm).

Figure 6:
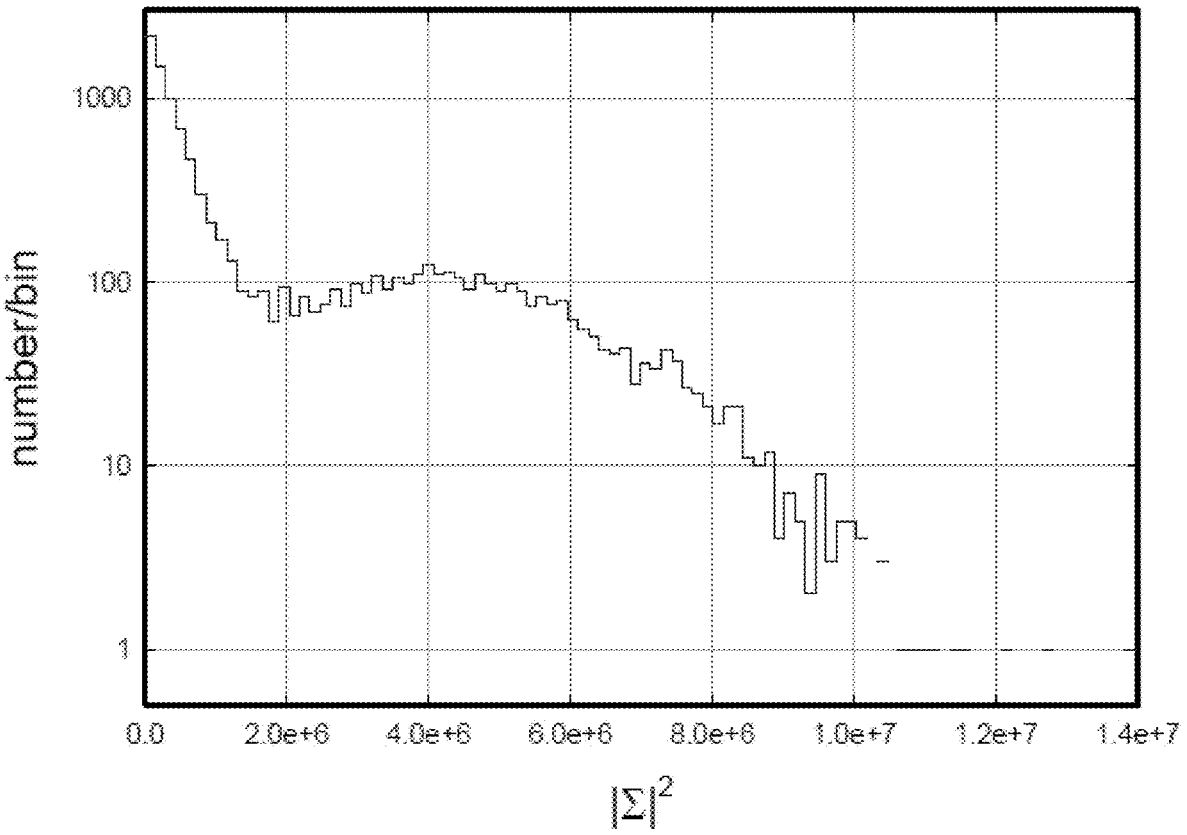
FIG. 6 is a histogram of intensity for speckle pattern according to one or more embodiments of the presently disclosed subject matter.

It is of interest to examine the intensity distribution in the case of beam formation. In FIG. 6 we show a histogram of the intensities when the emitting dipole density is $10^9$ $cm^{-2}$. This intensity distribution corresponds to the beam illustrated in FIG. 2, which shows some diffraction rings inside near the boundary of the circle. The brightest speckles are seen to be associated with the outermost diffraction ring which is on average brightest. Once again the individual speckles in this calculation are very small, and we would not expect them to account for the intense spots seen in Karabut's experiment.

Surface Deformation Effects

After a number of runs in the glow discharge, the cathode has undergone plastic deformations. Consequently, the presence of a mathematically flat surface is not expected, even if the cathode somehow started out mathematically flat. There are also transient effects associated with compressional, transverse, and drum head mode excitation. It is expected that the largest dynamic effects are due to excitation of the drum head modes.

It is possible to include these effects in the description by working with a displacement field u(x, y, t) which keeps track of the amount of displacement in the different directions. The intensity pattern including surface displacement can be written as $$I(r, t) \sim \left|\sum_j \exp\{ik|r - r_j - u(r_j, t)|\}\right|^2. \quad \text{Equation 28}$$

The idea here is that the dipole positions $r_j$ are specified in the case of a mathematically flat surface. When the surface is displaced, the (slowly varying) displacement is added systematically to the initial positions of the dipoles in the contribution to the phase factors.

Since the largest effect to come from drum head mode displacements and plastic deformations is expected, the surface displacement can be restricted to be normal to the surface $$u(r,t)+\hat{i}_z u(x,y,t). \quad \text{Equation 29}$$

It will be informative to consider the impact of low-order variations in the displacement; consequently, working with a Taylor series expansion around the origin results in $$u(x, y, t) = u(0, 0, t) + x\frac{\partial u}{\partial x} + y\frac{\partial u}{\partial y} + \frac{1}{2}x^2\frac{\partial^2 u}{\partial x^2} + xy\frac{\partial^2 u}{\partial x \partial y} + \frac{1}{2}y^2\frac{\partial^2 u}{\partial y^2} + \dots, \quad \text{Equation 30}$$

where the various derivatives are evaluated at x=0 and y=0, and may be oscillatory in time.

Uniform Displacement

We consider first the impact of a uniform displacement $$u(x,y,t)=u(0,0,t)=u_0(t). \quad \text{Equation 31}$$

FIG. 5 illustrates a histogram of intensity for speckle pattern with the weak beam of FIG. 4.

FIG. 6 illustrates a histogram of intensity for speckle pattern with the beam of FIG. 2 formed at an emitting dipole density of $10^9$ dipoles/$cm^2$.

In this case the intensity can be defined as $$I(r, t) \sim \left|\sum_j \exp\{ik|r - r_j - \hat{i}_z u_0(t)|\}\right|^2 = \left|\sum_j \exp\left\{ik\sqrt{(x - x_j)^2 + (y - y_j)^2 + (Z - u_0(t))^2}\right\}\right|^2. \quad \text{Equation 32}$$

Because the largest displacement is expected to be very small compared to the distance between the cathode and image plane $$|u_0(t)| \ll Z, \quad \text{Equation 33}$$

Observable effects are not anticipated from uniform surface displacements.

Linear Displacements

Next consider linear displacements of the form $$u(x,y,t)=a(t)x+b(t)y. \quad \text{Equation 34}$$

In this case intensity can be defined as $$I(r,t) \sim \left| \sum_j \exp\left\{ ik \sqrt{\begin{matrix}(x-x_j)^2+(y-y_j)^2+\\ [Z-a(t)x_j-b(t)y_j]^2\end{matrix}} \right\} \right|^2. \quad \text{Equation 35}$$

The beam is expected to be offset (in the high dipole density limit) depending on the surface gradient. This effect can be accounted for by writing $$I(r'(t),t) = I\left(r+\hat{i}_x\delta x(t)+i_y\delta y(t),t\right) \quad \text{Equation 36}$$

$$\sim \left| \sum_j \exp\left\{ ik \sqrt{\begin{matrix}[x+\delta x(t)-x_j]^2+\\ [y+\delta y(t)-y_j]^2+\\ [Z-a(t)x_j-b(t)y_j]^2\end{matrix}} \right\} \right|^2.$$

Eliminate some of the low-order terms in the phase by choosing $$\delta x(t)=-Za(t),\ \delta y(t)=-Za(t). \quad \text{Equation 37}$$

Focusing on the beam originally at the origin of the image plane results in $$I\left(\hat{i}_x\delta x(t)+i_y\delta y(t),t\right) \sim \left| \sum_j \exp\left\{ ik \sqrt{\begin{matrix}[\delta x(t)-x_j]^2+\\ [\delta y(t)-y_j]^2+\\ [Z-a(t)x_j-b(t)y_j]^2\end{matrix}} \right\} \right|^2 \quad \text{Equation 38}$$

$$= \left| \sum_j \exp\left\{ ik \sqrt{\begin{matrix}x_j^2+y_j^2+Z^2+\\ \delta x(t)^2+\delta y(t)^2+\\ [a(t)x_j-b(t)y_j]^2\end{matrix}} \right\} \right|^2.$$

If the displacements are small, then the higher-order terms can be neglected, which approximately yields $$I\left(\hat{i}_x\delta x(t)+i_y\delta y(t),t\right) \sim \left| \sum_j \exp\left\{ ik\sqrt{x_j^2+y_j^2+Z^2} \right\} \right|^2. \quad \text{Equation 39}$$

In this approximation the beam is collimated normal to the displaced surface, which is mathematically flat but not in the x-y plane. The neglected phase factors in this case are present since the image plane is not collinear with the displaced flat surface.

Surface Curvature

If the surface is curved, there is the possibility of increasing or reducing the beam intensity, since it may be that phase coherence can be maintained for more emitting dipoles. In general a curved surface can be described through displacements of the form $$u(x,y)=c(t)x^2+d(t)y^2+f(t)xy. \quad \text{Equation 40}$$

This yields $$I(r,t) \sim \left| \sum_j \exp\left\{ ik \sqrt{\begin{matrix}|r-r_j-\hat{i}_z\\ [c(t)x_j^2+d(t)y_j^2+\\ f(t)x_jy_j]|\end{matrix}} \right\} \right|^2 \quad \text{Equation 41}$$

$$= \left| \sum_j \exp\left\{ ik \sqrt{\begin{matrix}(x-x_j)^2+(y-y_j)^2+\\ [Z-c(t)x_j^2-d(t)y_j^2-\\ f(t)x_jy_j]^2\end{matrix}} \right\} \right|^2.$$

The intensity at the origin reduces to $$I(0,0,Z,t) \sim \left| \sum_j \exp\left\{ ik \sqrt{\begin{matrix}x_j^2+y_j^2+[Z-c(t)x_j^2-\\ d(t)y_j^2-f(t)x_jy_j]^2\end{matrix}} \right\} \right|^2. \quad \text{Equation 42}$$

It is possible to arrange for cancellation if $$2Zc(t)=1,\ 2Zd(t)=1,\ f(t)=0. \quad \text{Equation 43}$$

This results in $$I(0,0,Z,t) \sim \left| \sum_j \exp\left\{ ik\sqrt{Z^2+\frac{(x_j^2+y_j^2)^2}{4Z^2}} \right\} \right|^2 \quad \text{Equation 44}$$

$$= \sum_j \sum_{j'} \exp\left\{ ik \left( \sqrt{Z^2+\frac{(x_j^2+y_j^2)^2}{4Z^2}} - \sqrt{Z^2+\frac{(x_{j'}^2+y_{j'}^2)^2}{4Z^2}} \right) \right\}.$$

Using a Taylor series expansion the equation can be expressed as $$\sqrt{Z^2+\frac{\rho_j^4}{4Z^2}} - \sqrt{Z^2+\frac{\rho_{j'}^4}{4Z^2}} = \frac{\rho_j^4-\rho_{j'}^4}{8Z^3}+\ldots \quad \text{Equation 45}$$

The intensity in this limit is approximately $$I(0,0,Z,t) \sim \sum_j \sum_{j'} \exp\left\{ ik\left( \frac{(x_j^2+y_j^2)^2-(x_{j'}^2+y_{j'}^2)^2}{8Z^3} \right) \right\}. \quad \text{Equation 46}$$

It is probably simplest to evaluate the expectation value assuming N emitting dipoles in a circular area with radius $\rho_0$ around the origin, in which case the expectation value of the intensity is $$E[I(0,0,Z,t)] \sim E\left[\sum_j \sum_{j'} \exp\left\{ik\left(\frac{(x_j^2+y_j^2)^2-(x_{j'}^2+y_{j'}^2)^2}{8Z^3}\right)\right\}\right] = N^2\left|E\left[\exp\left\{ik\left(\frac{\rho_j^4}{8Z^3}\right)\right\}\right]\right|^2. \quad \text{Equation 47}$$

Evaluate the expectation value using a radial probability distribution given by $$f(\rho) = \begin{cases} \frac{2\rho}{\rho_0^2}, & 0 \le \rho \le \rho_0, \\ 0, & \text{otherwise.} \end{cases} \quad \text{Equation 48}$$

Results in $$E\left[\exp\left\{ik\left(\frac{\rho_j^4}{8Z^3}\right)\right\}\right] = \frac{2}{\rho_0^2}\int_0^{\rho 0} \rho \exp\left\{ik\left(\frac{\rho^4}{8Z^3}\right)\right\} d\rho. \quad \text{Equation 49}$$

If the circle is sufficiently large, so that $$\frac{k\rho_0^4}{8Z^3} = \frac{\pi\rho_0^4}{4\lambda Z^3} \gg 1 \quad \text{Equation 50}$$

(the characteristic value of $\rho_0$ for the numbers under consideration is about 2.5 mm) then the following result is obtained $$E\left[\exp\left\{ik\left(\frac{\rho_j^4}{8Z^3}\right)\right\}\right] \to \frac{1}{\sqrt{-i}}\sqrt{\frac{2\pi Z^3}{k\rho_0^4}}. \quad \text{Equation 51}$$

This can be simplified to $$E\left[\sum_j \sum_{j'} \exp\left\{ik\left(\frac{(x_j^2+y_j^2)^2-(x_{j'}^2+y_{j'}^2)^2}{8Z^3}\right)\right\}\right] = \left(\frac{2\pi Z^3}{k\rho_0^4}\right)N^2 = \left(\frac{\lambda Z^3}{\rho_0^4}\right)N^2. \quad \text{Equation 52}$$

This is a much greater intensity than was obtainable with earlier models. Collimated X-ray emission under conditions where the surface is distorted in this way can result in a very intense beam with a corresponding small spot size at the image plane.

Figure 7:
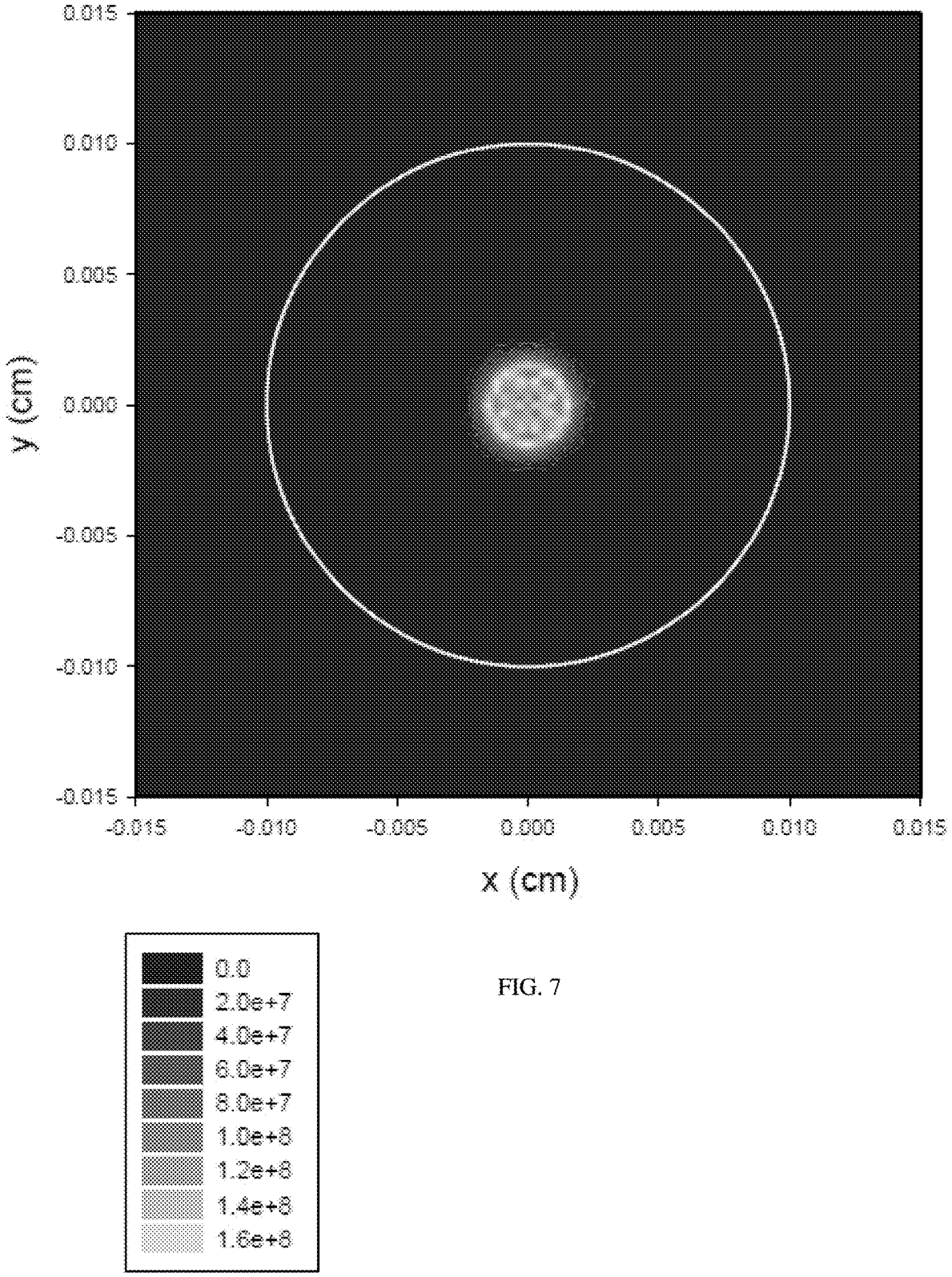
FIG. 7 is a beam image plane graph according to one or more embodiments of the presently disclosed subject matter.
Figure 8:
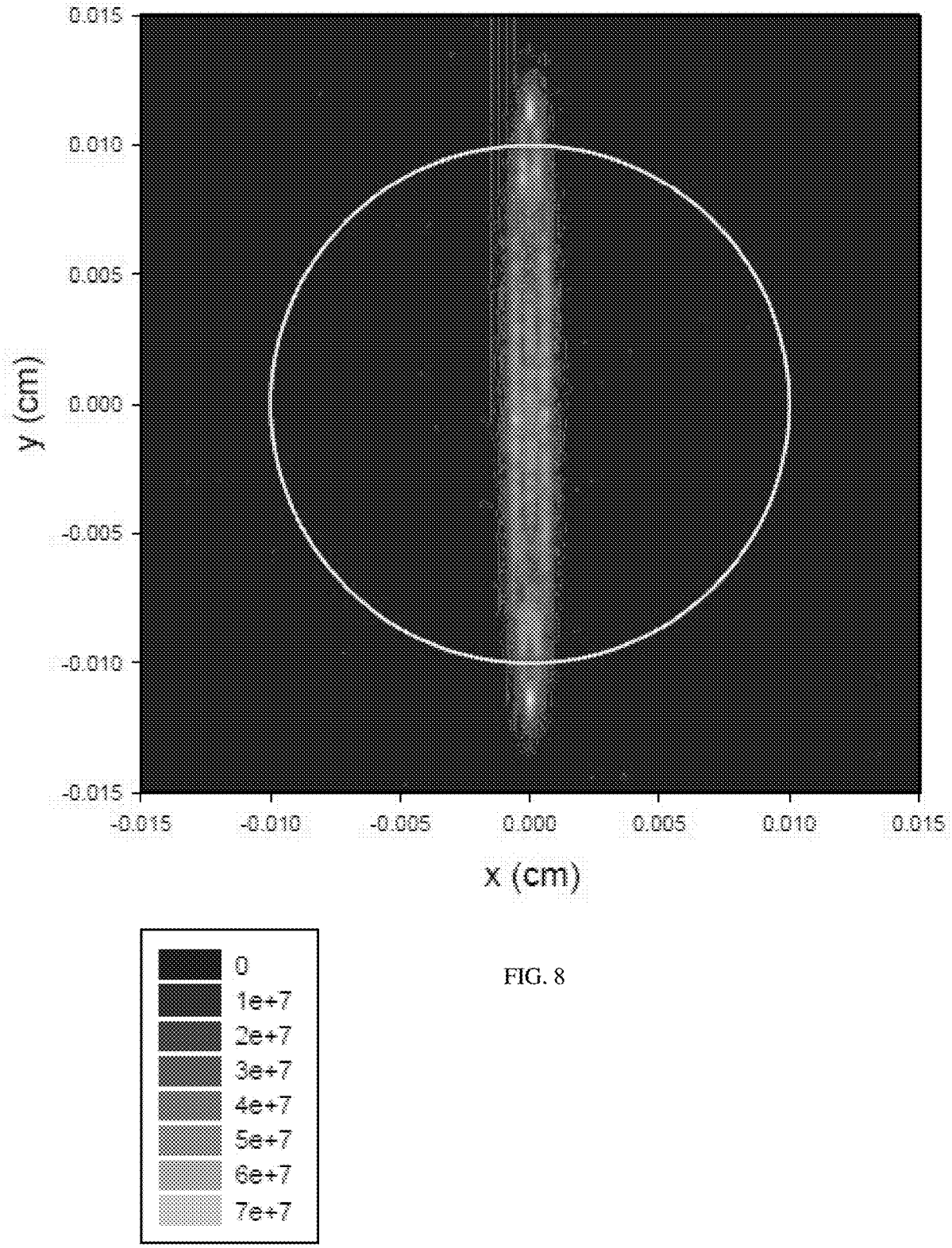
FIG. 8 is a beam image plane graph according to one or more embodiments of the presently disclosed subject matter.

Surface displacement in this case is a focusing effect, with no enhancement in the area integral of the intensity at the image plane. An example of a focused beam with parameters $$c(t) = 0.80\frac{1}{2Z},\quad d(t) = 0.80\frac{1}{2Z},\quad f(t) = 0 \quad \text{Equation 53}$$

is illustrated in FIG. 7. A beam in the shape of a line longer than the size of the circle containing the emitting dipoles is shown in FIG. 8. In this case the distorted surface parameters are $$c(t) = -0.30\frac{1}{2Z},\quad d(t) = 0.90\frac{1}{2Z},\quad f(t) = 0. \quad \text{Equation 54}$$

FIG. 7 illustrates a partially focused beam at image plane located at Z=25 cm in the case of a dipole density of $10^9$ cm−2. Marked is a circle of radius 100 μm.

DISCUSSION AND CONCLUSIONS

Collimated X-ray emission in the Karabut experiment is an anomaly that cannot be understood based on currently accepted solid state and nuclear physics, which provides motivation for seeking an understanding of the effect. There are two possible origins of a collimation effect: either an X-ray laser has been created; or else beam formation is due to phased array emission. The presently disclosed subject matter teaches against the proposal that an X-ray laser has been created, in part due to the absence of any compelling mechanism to produce a population inversion, in part due to the associated high power density requirement, and in part due to the mismatch between the geometry needed for beam formation and the geometry of the experiment.

Instead the present disclosure concludes that the collimation is a consequence of phased array emission, a proposal which on the one hand is free of the strong objections against an X-ray laser mechanism, but which on the other hand brings new issues to resolve. The two most significant mechanistic issues are how excitation in the keV range can be produced, and how phase coherence might be established. These problems are very serious; however, there are plausible mechanisms for both of these issues.

Of interest are mechanisms that might down convert a large nuclear quantum in the Fleischmann-Pons experiment, to account for excess heat as due to nuclear reactions without commensurate energetic nuclear radiation. An obstacle in understanding the mechanism through which excess heat is produced is that in a successful experiment one has the possibility of measuring thermal energy and $^4$He in the gas phase, neither of which at this point shed much light on whatever physical mechanism is involved.

FIG. 8 illustrates a beam partially focused in x and defocused in y at image plane located at Z=25 cm in the case of a dipole density of $10^9$ cm$^{-2}$. Marked is a circle of radius 100 μm.

If the large nuclear quantum is being down-converted, then the down-conversion mechanism should be tested in a different kind of experiment more easily diagnosed and interpreted. Because of the intimate theoretical connection between up-conversion and down-conversion, it is possible to understand how down-conversion works by studying up-conversion. Initially contemplated was a theory-based experiment in which THz vibrations would be up-converted to produce excitation at 1565 eV in $^{201}$Hg nuclei, which has the lowest energy excited state of all the stable nuclei, and which would decay primarily by internal conversion but also in part via X-ray emission. In this proposed theory-based experiment it was recognized that the up-conversion of vibrational energy would result in phase coherence, with the possibility of phased array beam formation. The claim of collimated X-ray emission near 1.5 keV in the Karabut experiment was noteworthy since it seemed that the up-conversion experiment might have already been implemented. From this perspective collimation in the Karabut experiment could be interpreted as an experimental confirmation of the up-conversion mechanism, primarily since there seems to be no other plausible interpretation. Collimated X-ray emission claimed in some cases near 1.5 keV in water jet experiments seem to be closely related, and to provide another experiment where up-conversion is observed.

One motivation for the modeling described in the presently disclosed subject matter was to see what constraints may develop on the number of emitting dipoles involved, which would shed light on the number of mercury atoms present on the surface. Initially it was understood that low levels of mercury as an impurity in the cathodes or in the gas might be responsible for the collimated emission; however, the spectra published by Karabut shows no indication of edge absorption which favors implantation from mercury contamination in the discharge gas. For example, the K-edge absorption in aluminum starts at 1562 eV, which should be readily apparent if the emission originates in the bulk. The transmission for a 1 μm Al layer is close to 90% below the K-edge, and near 30% above the K-edge (see FIG. 9).

Figure 9:
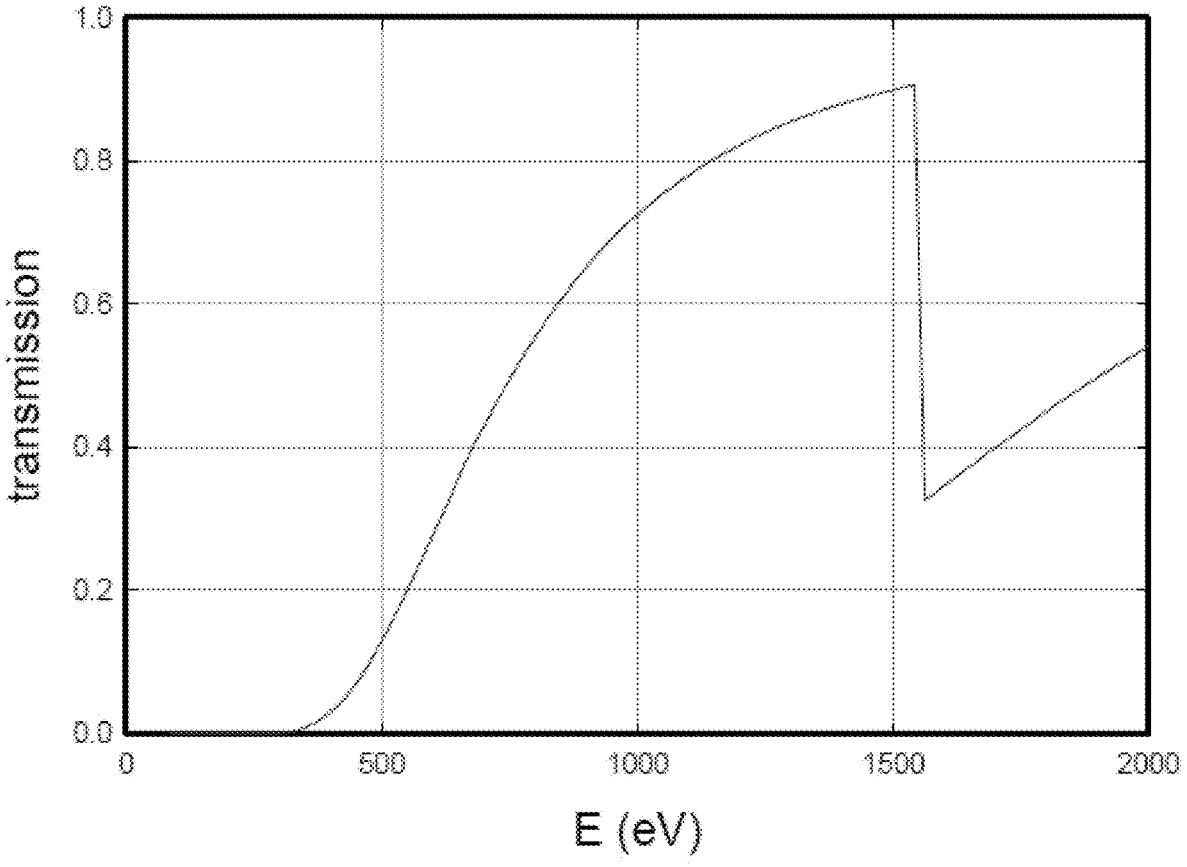
FIG. 9 is a graph of transmission as a function of energy according to one or more embodiments of the presently disclosed subject matter.

FIG. 9 illustrates transmission through 1 μm of Al as a function of the X-ray energy from an online x-ray transmission calculator.

This difference would be readily apparent in the spectra if the emission was due to bulk radiators. The absence of an observable K-edge absorption feature in the spectrum suggests that the emission is localized to within 0.1 μm or less from the surface, which is consistent with implantation from the mercury as an impurity in the discharge gas. Beam formation requires a dipole density above a threshold value, and it is estimated the threshold to correspond to about $1.5\times10^{11}$ emitting dipoles in the Karabut experiment. It is probable that the total number of dipoles is on the order of $1.5\times10^{12}$ or higher, to be consistent with unambiguous beam formation. Since the natural abundance of $^{201}$Hg is 13.18%, this puts the total number of mercury atoms at or above $10^{13}$.

The model for beam formation was based on emitting dipoles randomly positioned on a mathematical plane within a circle, to match the cathode geometry in Karabut's experiment. Beam formation in this case requires both uniform phase, and for there to be a mathematical plane to restrict random variations in position normal to the surface. It was previously assumed that the dipoles were randomly spaced in a volume near the surface, which could produce speckles, but this model does not produce a beam of about the same size as the cathode. The orientation of the crystal planes aligned with the surface produced by the rolling process used in the fabrication of the foils from which the cathodes are taken is critical for beam formation, based on the model formulated in the presently disclosed subject matter.

The origin of the very intense spots and lines that appear on the film (and which produces film damage) has been the subject of much speculation. Various explanations include that small fraction of the surface produces a collimated beam to form a spot, and that a line might be produced by a steering effect. The presently disclosed subject matter illustrates that surface deformation can produce a focusing of the beam, both in one dimension to produce a line, and in two dimensions to produce a spot. This new picture provides a much stronger argument than the earlier speculation.

It has been speculated that the bursts in emission following the turning off of the discharge was due to nonlinear Rabi oscillations in the donor and receiver model, a proposal strongly criticized on the grounds that the strong coupling needed to produce such rapid nonlinear Rabi oscillations was unlikely. However, in these models the burst effect comes about from the basic time dependence of the phonon-nuclear coupling matrix element, which in this case involves two photon exchange since the transition is M1 and the phonon-nuclear interaction is E1, to produce a $\cos^4 \omega_0 t$ time-dependence which is sharpened by a nonlinearity associated with local up-conversion effects. In this picture the excitation of the $^{201}$Hg transition is from excitation transfer from much more strongly coupled transitions in the cathode holder and steel target chamber, and drum head mode excitation of the cathode mediates this excitation transfer.

Disclosed herein is a method of generating a collimated electromagnetic emission. The method includes producing an excitation in a sample of multiple particles by vibrationally stimulating the sample thereby transitioning each particle of at least a quantity of the multiple particles from a lower first energy state to a higher second energy state. The method also includes generating a collimated electromagnetic emission by de-excitation of at least a portion of the quantity of the multiple particles.

According to one or more embodiments, vibrationally stimulating the sample includes establishing phase coherence among at least some of the multiple particles of the sample.

According to one or more embodiments, the collimated electromagnetic emission is generated by phased array emission.

According to one or more embodiments, the multiple particles of the sample are positioned on a planar support surface.

According to one or more embodiments, the planar support surface includes a cathode.

According to one or more embodiments, as the electromagnetic emission is generated, the multiple particles include phase coherent emitting dipoles.

According to one or more embodiments, the multiple particles of the sample are randomly positioned on the planar support surface.

According to one or more embodiments, the collimated electromagnetic emission includes a beam directed normal to the planar support surface.

According to one or more embodiments, the multiple particles of the sample are positioned within an area on the planar support surface, and the beam has a cross-sectional area essentially equivalent to the area on the planar support surface.

According to one or more embodiments, the planar support surface includes aligned crystal planes.

According to one or more embodiments, the crystal planes are aligned by rolling.

According to one or more embodiments, the planar support surface includes deformations that are quadratic or higher-order in transverse surface coordinates.

According to one or more embodiments, the deformations are produced by at least one of ion bombardment and sputtering.

According to one or more embodiments, the beam has a shape predetermined by a selected preparation of the deformations.

According to one or more embodiments, the collimated electromagnetic emission includes a beam generated by phased array emissions from the multiple particles of the sample, the multiple particles of the sample are positioned on a support surface having a circular diameter, and the support surface varies from a plane according to the time varying function $u(x, y)=c(t)x^2+d(t)y^2+f(t)xy$ in which u is defined as a displacement from the plane, x is defined as a first position coordinate along a first axis in the plane, y is defined as a second position coordinate along a second axis in the plane perpendicular to the first axis, c(t) is a time varying first parameter, d(t) is a time varying second parameter, and d(t) is a time varying third parameter.

According to one or more embodiments, the beam focuses as a spot smaller than the circular diameter at a distance Z from the support surface when c(t)=0.80/2Z; d(t)=0.80/2Z; and f(t)=0.

According to one or more embodiments, the beam focuses as a line segment having a length greater than the circular diameter at a distance Z from the support surface when c(t)=−0.30/2Z; d(t)=0.90/2Z; and f(t)=0.

According to one or more embodiments, vibrationally stimulating the sample includes producing excitations via up-conversion of vibrational energy.

According to one or more embodiments, the collimated electromagnetic emission includes X-ray emission.

According to one or more embodiments, the X-ray emission is generated by up-conversion of vibrational energy resulting in phase coherence.

Figure 10:
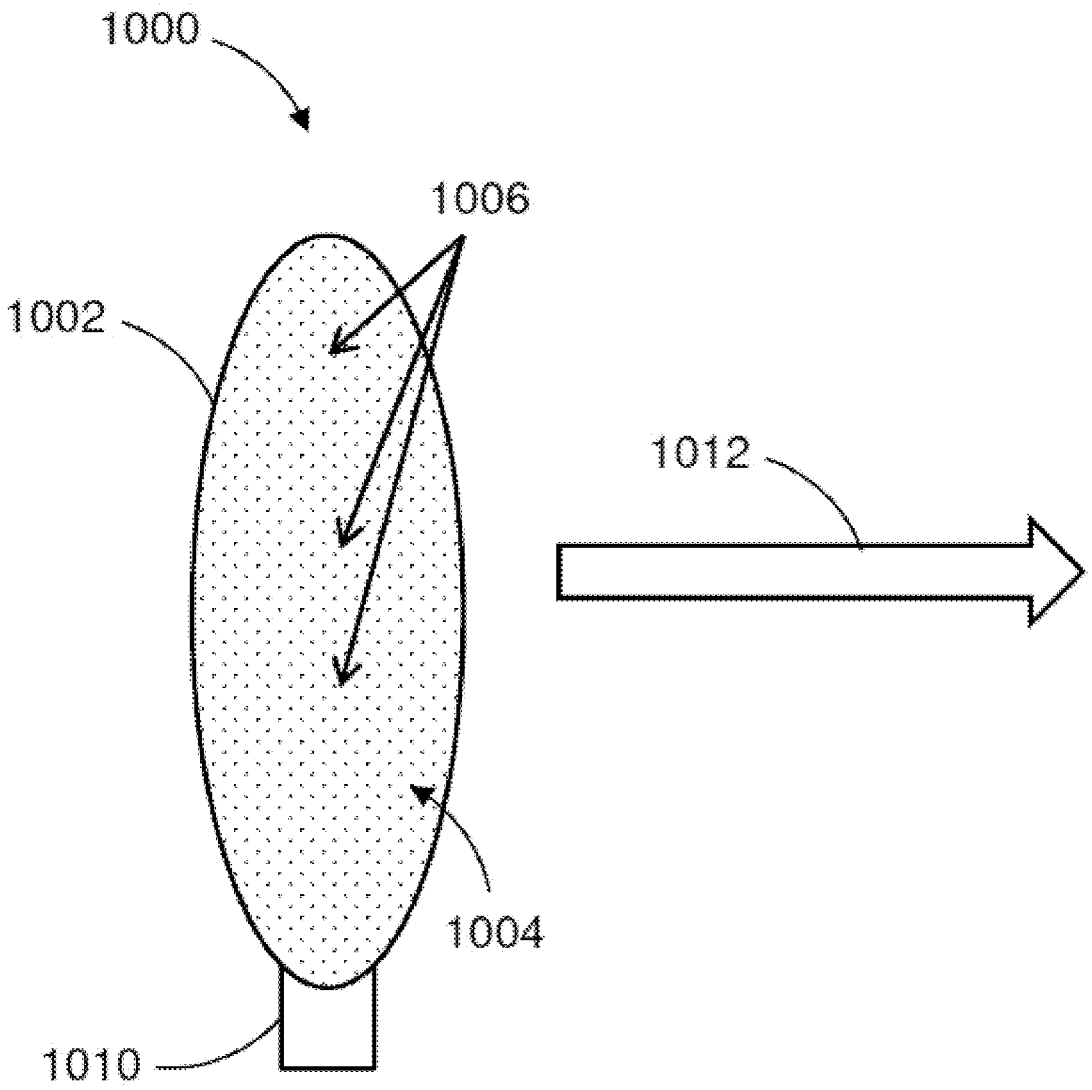
FIG. 10 is a diagram of an apparatus according to one or more embodiments of the presently disclosed subject matter.

According to one or more embodiments, and as illustrated in FIG. 10, an apparatus 1000 for generating a collimated electromagnetic emission includes a support structure 1002 having a surface 1004 and a sample of multiple particles 1006 positioned on the surface 1004. The apparatus 1000 also includes a device 1010 configured to vibrationally stimulate the sample thereby transitioning each particle of at least a quantity of the multiple particles from a lower first energy state to a higher second energy state such that a collimated electromagnetic emission 1012 is generated by de-excitation of at least a portion of the quantity of the multiple particles.

According to one or more embodiments, the surface of the support structure is planar.

According to one or more embodiments, the collimated electromagnetic emission includes a beam directed normal to the surface.

According to one or more embodiments, the multiple particles of the sample are randomly positioned on the surface.

According to one or more embodiments, the surface includes deformations that are quadratic or higher-order in transverse surface coordinates.

According to one or more embodiments, the support structure includes a cathode.

According to one or more embodiments, the surface includes aligned crystal planes.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

These and other changes can be made to the disclosure in light of the above Detailed Description. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the disclosure to the specific embodiments disclosed in the specification, unless the above Detailed Description section explicitly defines such terms.

Accordingly, the actual scope of the disclosure encompasses not only the disclosed embodiments, but also all equivalent ways of practicing or implementing the disclosure under the claims.

What is claimed is:

1. A method of generating a collimated electromagnetic emission, the method comprising:

producing an excitation in a sample of multiple particles by vibrationally stimulating the sample thereby transitioning each particle of at least a quantity of the multiple particles from a lower first energy state to a higher second energy state, wherein the multiple particles of the sample are positioned on a planar support surface, and wherein the planar support surface comprises deformations that are quadratic or higher-order in transverse surface coordinates; and generating a collimated electromagnetic emission by de-excitation of at least a portion of the quantity of the multiple particles.

2. The method of claim 1, wherein vibrationally stimulating the sample comprises establishing phase coherence among at least some of the multiple particles of the sample.

3. The method of claim 1, wherein the collimated electromagnetic emission is generated by phased array emission.

4. The method of claim 3, wherein the planar support surface comprises a cathode.

5. The method of claim 4, wherein, as the electromagnetic emission is generated, the multiple particles comprise phase coherent emitting dipoles.

6. The method of claim 3, wherein the multiple particles of the sample are randomly positioned on the planar support surface.

7. The method of claim 3, wherein the collimated electromagnetic emission comprises a beam directed normal to the planar support surface.

8. The method of claim 7, wherein the multiple particles of the sample are positioned within an area on the planar support surface, and the beam has a cross-sectional area essentially equivalent to the area on the planar support surface.

9. The method of claim 7, wherein the planar support surface comprises aligned crystal planes.

10. The method of claim 9, wherein the crystal planes are aligned by rolling.

11. The method of claim 7, wherein the deformations are produced by at least one of ion bombardment and sputtering.

12. The method of claim 7, wherein the beam has a shape predetermined by a selected preparation of the deformations.

13. The method of claim 1, wherein:

the collimated electromagnetic emission comprises a beam generated by phased array emissions from the multiple particles of the sample;

the multiple particles of the sample are positioned on a support surface having a circular diameter; and the support surface varies from a plane according to the time varying function:

$$u(x,y)=c(t)x^2+d(t)y^2+f(t)xy$$

in which:

u is defined as a displacement from the plane;

x is defined as a first position coordinate along a first axis in the plane;

y is defined as a second position coordinate along a second axis in the plane perpendicular to the first axis;

c(t) is a time varying first parameter;

d(t) is a time varying second parameter; and d(t) is a time varying third parameter.

14. The method of claim 13, wherein the beam focuses as a spot smaller than the circular diameter at a distance Z from the support surface when:

$$c(t)=0.80/2Z;\ d(t)=0.80/2Z;\ \text{and}\ f(t)=0.$$

15. The method of claim 13, wherein the beam focuses as a line segment having a length greater than the circular diameter at a distance Z from the support surface when:

$$c(t)=-0.30/2Z;\ d(t)=0.90/2Z;\ \text{and}\ f(t)=0.$$

16. The method of claim 1, wherein vibrationally stimulating the sample comprises producing excitations via up-conversion of vibrational energy.

17. The method of claim 1, wherein the collimated electromagnetic emission comprises X-ray emission.

18. The method of claim 17, wherein the X-ray emission is generated by up-conversion of vibrational energy resulting in phase coherence.

19. An apparatus for generating a collimated electromagnetic emission, comprising:

a support structure having a surface, wherein the surface comprises deformations that are quadratic or higher-order in transverse surface coordinates;

a sample of multiple particles positioned on the surface;

a device configured to vibrationally stimulate the sample thereby transitioning each particle of at least a quantity of the multiple particles from a lower first energy state to a higher second energy state such that a collimated electromagnetic emission is generated by de-excitation of at least a portion of the quantity of the multiple particles.

20. The apparatus of claim 19, wherein the surface of the support structure is planar.

21. The method of claim 20, wherein the collimated electromagnetic emission comprises a beam directed normal to the surface.

22. The method of claim 20, wherein the multiple particles of the sample are randomly positioned on the surface.

23. The method of claim 19, wherein the support structure comprises a cathode.

24. The method of claim 19, wherein the surface comprises aligned crystal planes.

* * * * *